United States Patent [19]

Mancini

[11] 4,307,582

[45] Dec. 29, 1981

[54] HOLLOW, FLANGED EARRING POST CONSTRUCTION

[75] Inventor: William A. Mancini, Providence, R.I.

[73] Assignee: National Chain Co., Warwick, R.I.

[21] Appl. No.: 131,433

[22] Filed: Mar. 17, 1980

[51] Int. Cl.[3] ..... A44C 7/00

[52] U.S. Cl. ..... 63/12

[58] Field of Search ..... 63/12, 13; 29/160.6; 433/211; 24/208 R, 217 R, 219

[56] References Cited

U.S. PATENT DOCUMENTS

| | | | |
|---|---|---|---|
| 161,853 | 4/1875 | Baker | 63/12 X |
| 352,363 | 11/1886 | Shipman | 24/217 |
| 573,532 | 12/1896 | Pringle | 24/217 |
| 1,019,233 | 3/1912 | Edwards | 29/160.6 |
| 1,404,552 | 1/1922 | Simons | 24/219 |
| 1,840,285 | 1/1932 | Daughaday | 29/160.6 |
| 2,425,299 | 8/1947 | Ballou | 29/160.6 |
| 3,446,034 | 5/1969 | Driscoll | 63/13 |
| 3,605,438 | 9/1971 | Chalson | 63/12 X |
| 3,789,850 | 2/1974 | Ford | 128/329 |

*Primary Examiner*—F. Barry Shay

*Attorney, Agent, or Firm*—Salter & Michaelson

[57] ABSTRACT

A precious metal post for pierced earrings comprising an elongated hollow tubular member having a gently rounded closed end at one extremity thereof, the opposite extremity being open and adapted for connection to an ornamental member. The outer diameter of the post is approximately 0.035 inches and the wall thickness is approximately 0.004 inches. A thin coating of solder-flux material is provided on the interior surface of the post to facilitate securement of the post to the ornamental member.

2 Claims, 4 Drawing Figures

HOLLOW, FLANGED EARRING POST CONSTRUCTION

BACKGROUND AND SUMMARY OF THE INVENTION

The present invention relates generally to pierced earrings, and is particularly concerned with a novel and unique construction for the post member which forms a part of such earrings.

Generally speaking, pierced earrings comprise an ornament of one form or another to which an elongated post is connected, as by soldering or the like, the post being adapted to extend through the pierced opening in the wearer's ear lobe so that the ornament is positioned adjacent the outer surface of the wearer's lobe. The inner end of the post projects beyond the inner surface of the wearer's lobe and the earring is retained in its mounted position by means of a clutch member which frictionally and resiliently engages the exposed inner end of the post. In order to prevent infection and contamination to the wearer's ear, the earring post is usually constructed of precious metal, such as silver or gold. In fact, there are governmental regulations relating to the materials of which earring posts are constructed in order to minimize the danger of infection or contamination to the wearer.

It will be understood that the conventional earring post is of extremely small size, usually comprising a diameter of somewhere in the range of 0.035 inches. The length of the conventional post would normally be somewhere in the neighborhood of three-eighths of an inch. In dealing with a post of this minute size, the obvious way to construct such a method is of a solid material, whether it be gold, silver, or some other acceptable hypollergenic material. Due, however, to the recent tremendous increases in price of gold and silver, the cost of gold and silver earring posts, as small as the posts are, has become a significant factor and hence the purpose of the present invention is to provide a precious metal earring post that is still basically of the same size as a conventional solid post, but which uses significantly less metal and which nevertheless possesses sufficient structural strength so as to be effective.

The present invention achieves the foregoing objective by providing a precious metal earring post that is of hollow, tubular construction, thereby significantly lessening the amount of precious metal present in each post.

It is therefore a primary objective of the present invention to provide a precious metal earring post that is of hollow, tubular construction but which is still of substantially the same size as conventional solid posts.

Another object is the provision of a hollow, tubular precious metal post that has a generally rounded closed end at one extremity thereof to permit insertion of the post through the wearer's lobe without any discomfort.

Another object of the present invention is the provision of a hollow post of the character described wherein the extremity of the post opposite to the closed end is open and may be provided with an integral outwardly extending circular flange for facilitating securement of the post to an ornament.

Still another object of the present invention is the provision of a hollow precious metal earring post of the character described wherein the inner surface of the hollow post is coated with a thin layer of a solder-flux material whereby when heat is applied to solder the aforesaid flange to an ornament, the solder coating will flow to the point of junction to provide the solder necessary to secure the flange to the ornament.

DESCRIPTION OF THE DRAWING

In the drawing which illustrates the best mode presently contemplated for carrying out the present invention.

DESCRIPTION OF THE INVENTION

Figure 1:
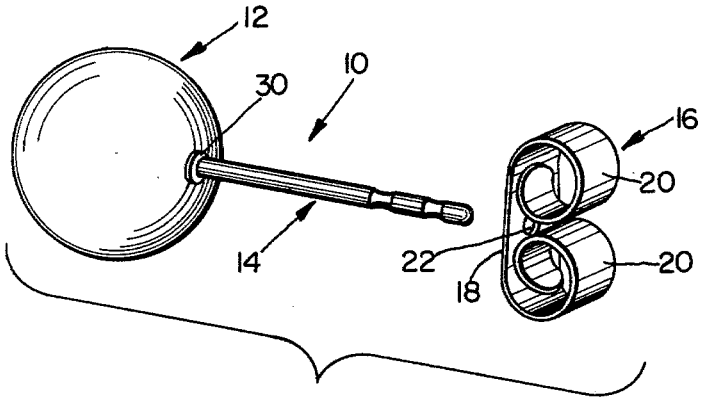
FIG. 1 is an exploded perspective view showing an earring embodying a post construction in accordance with the present invention and also showing the clutch member that is used in association therewith.

Referring to the drawings, and more particularly FIG. 1 thereof, there is shown an earring 10 comprising an ornament 12 to which a post 14 has been secured. The assembly is completed by a clutch 16 which is adapted to frictionally and resiliently engage the inner free end of post 14 to maintain the earring on the wearer's ear, all in a conventional and well-known manner. As will be noted, the clutch member 16, which is constructed of any suitable resilient material, usually metal, comprises a base portion 18 having a pair of oppositely disposed curled ends 20 which are adapted to be resiliently forced apart when post 14 is inserted through opening 22 and is forced between the curled portions 20. It will be understood that the clutch member per se forms no part of the instant invention and other well-known types of friction clutches could be employed. By the same token, although the ornament 12 is shown as comprising a spherical member, any suitable configured or designed ornament may be utilized.

Figure 2:
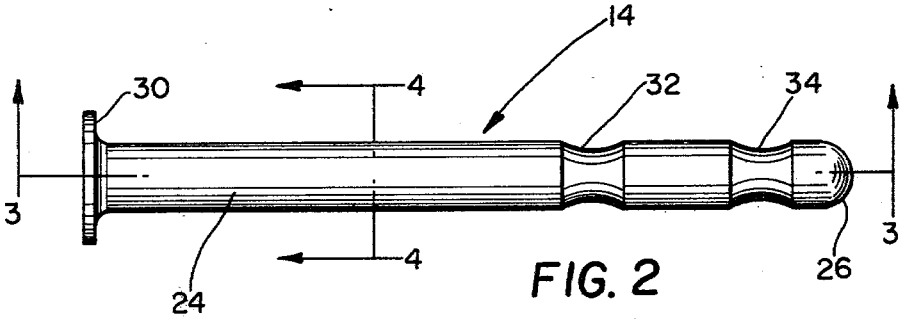
FIG. 2 is a side elevational view of the post per se.

The novelty in the present invention resides in the construction of the post 14. As will be most apparent from FIGS. 2 and 3, the post 14 comprises an elongated hollow tubular member 24 having a gently rounded closed end 26 at one extremity thereof and being open at its opposite extremity, as at 28. An outwardly extending circular flange 30 may be provided at the opening 28, the purpose of which is to facilitate securement of the post 14 to the ornament 12 by any suitable means, such as soldering or the like. In order to releasably position the clutch member 16 at desired locations on post 14, the latter is provided with a plurality of circumferentially extending depressions 32, 34, in spaced relation to each other and located adjacent to but spaced from closed end 26. Thus, when clutch member 16 is slidably engaged on the post 14, depressions or detents 32, 34 may be selectively engaged depending on the thickness of the wearer's lobe. Thus, the plurality of depressions or detents provide adjustable mounting locations for clutch member 16, it being understood that any desired number of depressions or detents may be employed.

Figure 4:
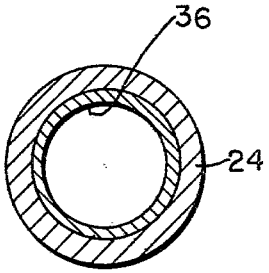
FIG. 4 is an enlarged section taken on line 4—4 of FIG. 2.
Figure 3:
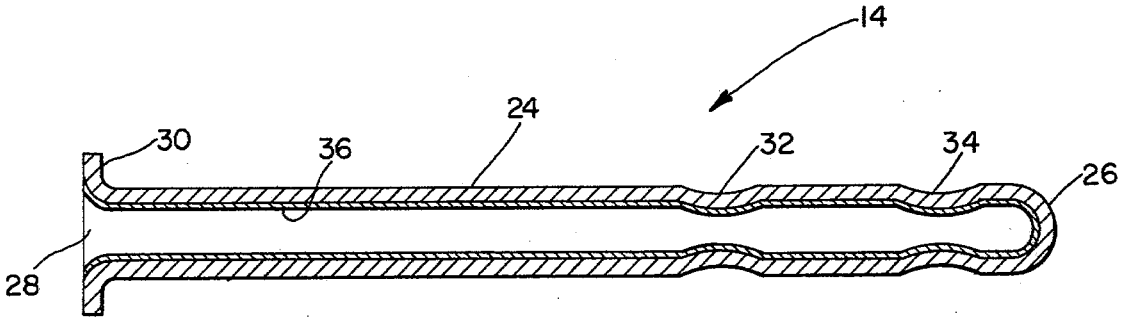
FIG. 3 is a section taken on line 3—3 of FIG. 2.

Referring now to FIGS. 3 and 4, it will be seen that the inner surface of the tubular post 14 is provided with a thin layer or coating 36 of solder-flux material whereby when it is desired to solder flange 30 to any suitable ornament, and heat is applied at the point where the connection is desired, the coating 36 will melt and flow to the point of connection to provide the necessary solder for effecting the desired joint.

It is important to understand that post 14 is of miniscule size, preferably comprising an outer diameter of approximately 0.035 inches, a wall thickness of approximately 0.004 inches, and a length of approximately three-eighths of an inch. Techniques which form no part of the present invention have been developed to manufacture the posts 14 in mass production and in spite of their extremely small size, the hollow tubular configuration of the post results in a significant saving of precious metal. On the other hand, the hollow tubular construction still exhibits sufficient structural strength and, in fact, the tubular configuration thereof may be even more resistant to bending than the comparably sized solid post.

Although flange 30 provides a convenient means for facilitating securement of post 14 to ornament 12, particularly when a solder connection is being effected, it will be understood that post 14 may be secured or connected to ornament 12 by other suitable means that will not require the presence of flange 30.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A precious metal post for pierced earrings comprising an elongated hollow, tubular member open at one end and having a gently rounded closed end at the opposite extremity thereof, said post comprising a circular flange extending outwardly therefrom at said open end, said post further comprising a thin coating of solder-flux material over the interior surface of the bore of said tubular member, whereby when heat is applied to solder said flange to an ornament, said solder-flux coating will melt to provide the necessary solder for securing the flange to the ornament.

2. A pierced earring comprising a hollow elongated precious metal post, said post having a gently rounded closed end at one extremity thereof, the opposite extremity being open and having a circular flange extending outwardly therefrom, an ornamental member, means securing said flange to said ornamental member, a plurality of spaced circumferentially extending depressions on said post located adjacent to but spaced from said closed end, and a resilient clutch member frictionally engaging said post for selective positioning in one of said depressions.

* * * * *